United States Patent [19]

Rinehart

[11] Patent Number: 4,753,024

[45] Date of Patent: Jun. 28, 1988

[54] ANIMAL FOOT RACK AND KIT THEREFOR

[75] Inventor: John R. Rinehart, Janesville, Wis.

[73] Assignee: American Institute of Taxidermy, Inc., Janesville, Wis.

[21] Appl. No.: 41,604

[22] Filed: Apr. 23, 1987

[51] Int. Cl.[4] ..... A47G 1/06

[52] U.S. Cl. ..... 40/160; 434/296; 428/16

[58] Field of Search ..... 40/160; 428/16, 913.3; 434/295–297

[56] References Cited

U.S. PATENT DOCUMENTS

| | | | |
|---|---|---|---|
| 258,821 | 5/1882 | Stovck | 40/160 |
| 2,169,811 | 8/1939 | Nevison | 434/296 |
| 3,200,515 | 8/1965 | Daigre | 434/296 |

FOREIGN PATENT DOCUMENTS

| | | | |
|---|---|---|---|
| 2458018 | 6/1976 | Fed. Rep. of Germany | 434/296 |

*Primary Examiner*—John J. Wilson
*Assistant Examiner*—Michael Lynch
*Attorney, Agent, or Firm*—Isaksen, Lathrop, Esch, Hart & Clark

[57] ABSTRACT

A cured animal foot for mounting to a plaque includes an animal foot comprised of skin, bone, and flesh, having a lower portion with digits and an upper portion which at an upper end thereof has been cut from a leg of an animal, the upper and lower portions being joined at about a 90° angle at the wrist joint. The cured animal foot further includes a semi-stiff wire inserted longitudinally into the animal foot and extending into both the upper and lower portions of the animal foot. While the animal foot is still fresh, it is bent at the wrist to the desired angle and held thereat by the bent wire while the foot is cured in the bent configuration in a curing bath. The invention is carried out by providing a fresh animal foot and a semi-stiff wire, inserting the semi-stiff wire longitudinally into the foot so that the wire extends into both the upper and lower portions of the foot. The foot is then bent at the wrist to the selected angle. The semi-stiff wire maintians this selected angle between the lower and upper portions of the foot. The animal foot should then be placed into a curing bath for a sufficient period of time for the flesh and skin of the foot to cure, and thereby to help maintain the upper and lower portions of the foot at the selected angle to one another. The cured animal foot should then be removed form the bath to be dried and then mounted to a plaque.

25 Claims, 1 Drawing Sheet

ANIMAL FOOT RACK AND KIT THEREFOR

BACKGROUND OF THE INVENTION

1. Field of the Invention

This invention pertains generally to the field of taxidermy and particularly to the preparation of animal feet for rack mounting.

2. Description of the Prior Art

It is common practice in taxidermy to sew an animal foot such as a deer foot over an animal foot form which is bent at the wrist portion thereof at about a 90° angle so that the foot and form may be placed on a plaque to form a rack upon which articles may be hung or placed. The animal foot and attached skin is placed over the animal foot form so as to have the appearance of an animal foot bent at the wrist. When the bent animal foot is attached to the plaque, the hooves or toes generally point upwardly so that the bent animal foot performs the function of a hook or hanger. For example, two such deer feet which are each sewn over its respective form, can be placed and attached to opposite ends of a long rectangular plaque to form a deer foot rifle rack. When the rifle is placed in the rack, it is placed resting on what is the upper portion of the deer foot, which is mounted to the front of the plaque. The hooved or lower portion of the foot points upwardly and functions to hold the rifle in position on the horizontal upper portion of the deer foot. Other types of racks may be made such as fishing rod racks, bow racks, or hat racks. Racks may be made using the feet of various ungulate mammals such as sheep, caribou, and moose, or other animals such as foxes or big cats.

A considerable amount of work can go into preparing an animal foot to be placed over its right-angled animal foot form, and furthermore, additional work is required to permanently place the animal foot and skin over the form. Bone must be removed from the portion of the animal foot which is to be replaced by the form. Additionally, the skin often must be sewn over the form.

SUMMARY OF THE INVENTION

The present invention is summarized in that a cured animal foot for mounting to a plaque according to the present invention includes an animal foot with skin and bone having a lower portion with digits and an upper portion which at an upper end thereof has been cut from a leg of the animal, the upper and lower portions being joined at a selected angle at a wrist joint. The present invention further includes a semi-stiff wire inserted longitudinally into the animal foot and extending into both the upper and lower portions of the animal foot. The animal foot is bent at the wrist at a selected angle and is held thereat by the bent wire until the foot is hardened into its bent configuration in a curing bath. It is preferred that the semi-stiff wire be U shaped, having two arms with one end each, and a juncture where the arms join. The two arms of the wire are inserted by the ends thereof into the lower portion of the foot between the digits near the rear portions thereof. The semi-stiff wire is then pushed so that the arms thereof extend into the upper portion of the animal foot. It is preferred that the extended portions of the wire arms extend out beyond the cut end of the upper portion of the foot. It is also preferred that the arms of the semi-stiff wire be pushed up the animal foot so that the juncture adjoining the arms lies obscured by the digits. After the semi-stiff wire has been properly inserted into the animal foot, the foot should be bent at the wrist to the desired angle. The inserted wire will hold the animal foot in the desired position. The animal foot then may be dipped into the curing bath so that the skin and flesh cure to help maintain the animal foot in its selected configuration in which it is bent at the wrist. After the animal foot is removed from the curing bath to dry, a plaque may be provided and the cured animal feet mounted to the plaque to form an animal foot rack.

Further objects, features, and advantages of the invention will be apparent from the following detailed description when taken in conjunction with the accompanying drawings.

DESCRIPTION OF THE PREFERRED EMBODIMENT

Figure 1:
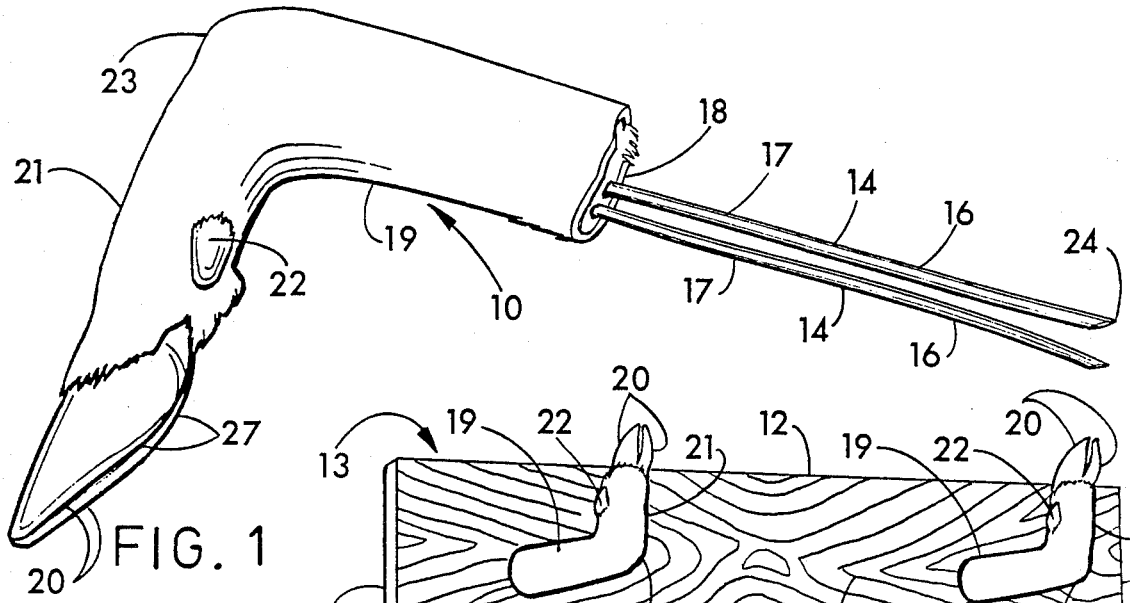
FIG. 1 is a side view of a cured animal foot for mounting to a plaque in accord with the present invention.
Figure 2:
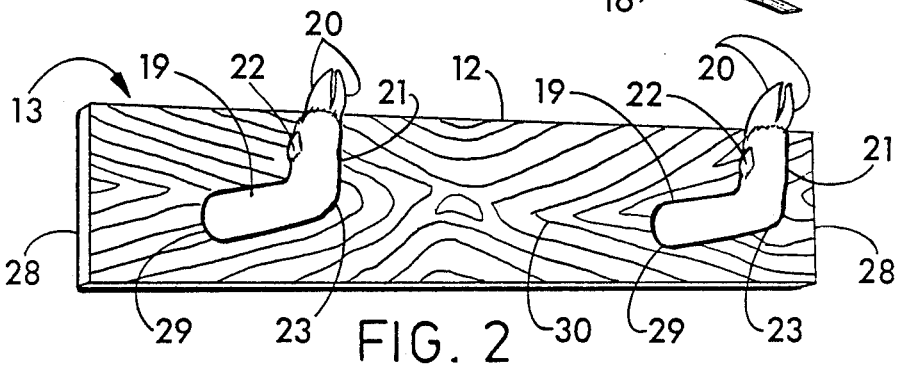
FIG. 2 is a perspective view of an animal foot rack in accord with the present invention.
Figure 3:
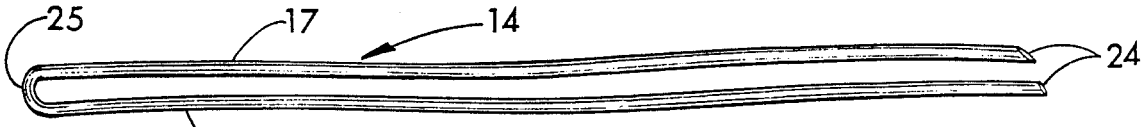
FIG. 3 is a perspective view of the semi-stiff wire used to produce the preferred cured animal foot for mounting to a plaque to form an animal foot rack.
Figure 4:
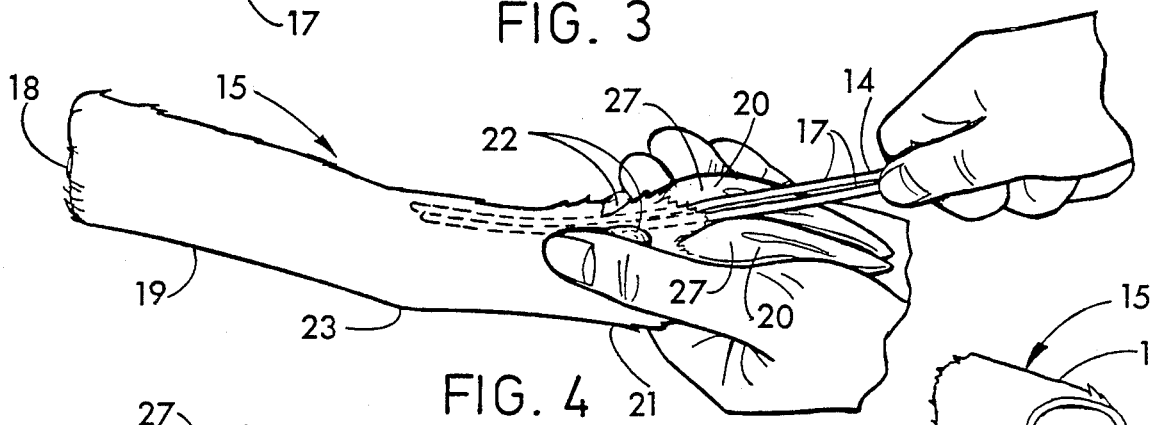
FIG. 4 is a side view of the semi-stiff wire of FIG. 3 being inserted into a fresh animal foot which is substantially straight at the wrist.

With reference to the drawings, a cured animal foot 10 for mounting to a plaque 12 is shown ready for mounting in FIG. 1. In this embodiment shown in FIG. 1, the animal foot happens to be a deer foot, but could also be the hooved foot of another ungulate animal such as sheep, caribou, or moose. The foot also could be from another type of animal such as a big cat or a fox which has toes for digits. When the cured animal foot 10 is mounted to a plaque 12, an animal foot rack according to the present invention is formed as shown in FIG. 2. FIG. 3 shows a semi-stiff wire 14 which according to the present invention is inserted into a fresh animal foot as shown in FIG. 4. After the semi-stiff wire is inserted into the fresh animal foot, extended portions 16 of the wire arms 17 should extend out beyond the cut end 18 of the upper portion of the fresh animal foot 15.

The fresh animal foot 15 is comprised of skin, bone, and flesh and has a lower portion 21 with a dew claw 22 and two hoof halves 20 and a upper portion 19, which at an upper end 18 thereof has been cut from a leg of the animal a few inches above the wrist joint 23. Although the particular digits which a deer foot has are hoof halves, other animals, such as big cats, have toes. The term "animal foot" is intended to include that part of the animal leg which extends a few inches above the wrist joint 23 and which will be called the "upper portion" of the foot. The upper portion 19 and lower portion 21 of the preferred cured animal foot 10 shown in FIG. 1 are preferably joined at about a 90° angle at the wrist joint 23. The semi-stiff wire 14 which is inserted longitudinally into the animal foot 10 extends into both the upper and lower portions 19 and 21 of the preferred cured animal foot 10. The semi-stiff wire 14 may be inserted longitudinally into the hollow portions 31 of the bones or even between the skin and bone of the animal foot 10. The semi-stiff wire 14 shown in FIG. 1 was inserted into the animal foot 10 while it was still fresh and flexible at the wrist. After the wire 14 was inserted, the animal foot 10 was bent at the wrist joint 23 so that the upper and lower portions 19 and 21 of the animal foot 10 formed about a right angle. The animal foot 10 was held at the right angle by the bent wire 14, and inserted into a curing bath (not shown) until the foot 10 was cured and thus hardened into its bent configuration.

Figure 5:
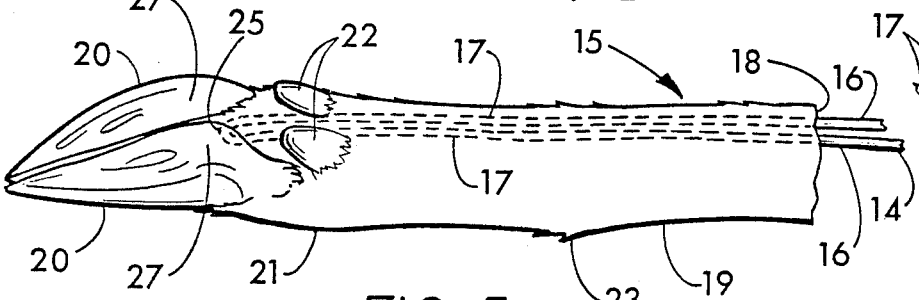
FIG. 5 is a perspective view of a fresh animal foot after the semi-stiff wire has been inserted therein, but before the animal foot has been bent at the wrist.
Figure 6:
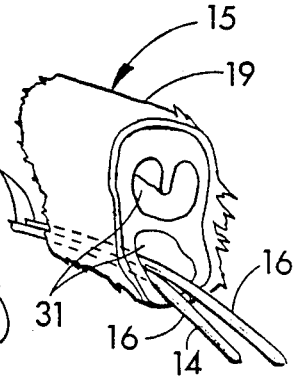
FIG. 6 is a perspective view of a portion of the animal foot viewing the cut end of the upper portion of the animal foot with the extended portions of the wire arms extending out beyond the cut end of the upper portion of the foot.

As shown in FIG. 3, the preferred semi-stiff wire 14 is U-shaped and has two arms 17 with one end 24 each, and a juncture 25 where the arms 17 adjoin one another. In describing the wire 14 as "semi-stiff", it is meant that the wire 14 can be bent by hand, for example when the wire is inserted into a fresh animal foot 15 and the animal foot 15 is bent at the wrist joint 23; and also that the wire 14 is stiff enough to maintain the flexible fresh animal foot 15 in this right angled bent configuration without any additional aid. The semi-stiff wire 14 is preferably inserted into the fresh animal foot 15 by pushing its ends 24 through the skin of the fresh animal foot 15 into the lower portion 21 of the foot 15 between the two hoof halves 20 near their rear portions 27. If the foot were the paw of a big cat, the wire 14 instead might be inserted between the toes or through a bottom of the foot. The wire 14 is then pushed into both the lower and upper portions 21 and 19 of the animal foot 15. After the wire 14 is inserted, the animal foot 15 may be bent at the wrist joint 23, so that the foot 15 is in a proper configuration for curing and mounting on a plaque. It is preferred that extended portions 16 of the wire arms 17 extend out beyond the cut end 18 of the upper portion 19 of the foot 15 and 10 as shown in FIGS. 1 and 5–6. Although the preferred cured animal foot 10 is bent at about a 90° angle at the wrist joint 23, the foot may be bent at any selected angle. It is desired that the two arms 17 of the semi-stiff wire be pushed up the animal foot 15 so that the juncture 25 adjoining the arms 17 lies obscured by the hoof halves 20 as shown in FIG. 5. In other animals, the juncture 25 might be obscured by the toes.

As shown in FIG. 2, one or more cured animal feet 10 may be mounted onto a plaque 12 with their cut ends 18 abutting against the plaque to form an animal foot rack 13. This preferred animal foot rack 13 has two cured animal feet 10 mounted near the ends 2B of a rectangular plaque 12, so that a rifle may be placed to rest on the upper portions 19 of the cured animal feet 10 and held thereon by the lower hooved portions 21. The means for mounting the cured animal feet 10 to the plaque 12 includes a portion 29 of the plaque behind each animal foot 10 cut end 18, each plaque portion 29 having two holes (not shown) from a front 30 to a back (not shown) of the plaque to receive the extended portions 16 of the wire arms 17 therethrough. The mounting means also may include a wound portion (not shown) formed to a rear of the plaque 12. The wound portion of the arms is formed by crossing the two extended portions 16 of the arms 17 and winding them around each other until tension in the arms pulls the cut end 18 of the animal feet 10 to firmly abut and press against the front 30 of the plaque 12 over the corresponding two holes. Alternatively, the mounting means could include a clamp (not shown) placed on each pair of extended portions 16 of the arms 17 to a rear of the plaque to hold the arms 17 in tension so that the cut end 18 of each animal foot 10 firmly abuts and presses against the front 30 of the plaque 12 around the corresponding two holes. Other racks could be made which would be used for holding bows, fishing rods, hats, or other articles.

It should be appreciated that the invention is carried out by first providing at least one animal foot 15 including skin, bone, and some fresh flesh therebetween having a lower portion 21 with at least two digits and an upper portion 19 which at an upper end thereof has been cut from a leg of an animal. The upper and lower portions 19 and 21 of the foot 15 are joined at a wrist joint 23 such that the portions are originally substantially aligned with one another. To carry out the invention, a semi-stiff wire 14 must also be provided. The semi-stiff wire can be longitudinally inserted into the hollow portions 31 of the bones or between the skin and bone of the fresh foot 15 so that the wire extends into both the upper and lower portions 19 and 21 of the fresh foot 15. The two ends 24 of the wire arms 17 are preferably poked into the lower portion 21 of the fresh foot 15 between the rear portions 27 of the hoof halves 20, toes, or other digits. The wire 14 then can be pushed longitudinally up the foot so that the wire extends up into both the upper and lower portions 19 and 21 of the foot. The wire 14 should be long enough, and pushed upwardly enough so that extended portions 16 of the wire arms 17 extend out beyond the cut end 18 of the upper portion 19 of the fresh foot 15 as shown in FIGS. 5 and 6. At the same time, the upward pushing of the wire 14 will preferably place the juncture 25 of the wire between the hoof halves 20 so that the juncture 25 is obscured by the hoof halves 20. With the feet of non-ungulate animals, the juncture 25 might be placed between the toes or other digits so that the juncture 25 is obscured by those toes or digits. After the wire 14 is properly inserted into the foot 15, the foot 15 can be bent at the wrist 23 to the desired selected angle, preferably about 90°. After the foot is so bent, the inserted wire 14 will maintain the lower and upper portions 21 and 19 of the foot 15 at the selected desired angle to one another. The fresh animal foot 15 in this right angled configuration should then be placed into a curing bath for a sufficient period of time for the flesh and skin of the foot 15 to cure, and thereby to help maintain the upper and lower portions 19 and 21 of the foot 10 at the selected angle in relationship to each other. The cured animal foot 10 should then be removed from the bath to dry. The chemicals used in the bath are alum and salt pickle bath. These chemicals serve to cure and tan the skin and fur.

A plaque 12 may then be provided on which the one or more cured animal feet 10 can be mounted to form an animal foot rack 13. Mounting a cured animal foot 10 to plaque 12 may be carried out by putting two holes (not shown) through portions 29 of the plaque 12 from the front 30 to the back (not shown) of the plaque 12 behind where the animal foot cut end 18 is to be placed. Each extended portion 16 of each wire arm 17 should be placed through one of the holes and pulled therethrough so that the cut end 18 of each animal foot 10 abuts against the front 30 of the plaque 12. The cured animal foot 10 may be permanently affixed in this position by crossing the two extended portions 16 of the arms 17 of each wire 14 and winding them around each other until the arms 17 are in tension so that the cut end 18 of the foot 10 presses against the front 30 of the plaque 12. Alternatively, a clamp (not shown) may be attached to the extended portions 16 of the wire arms 17 so that the clamp abuts against the back of the plaque 12 and holds the arms 17 in tension so that the cut end 18 of the foot 10 presses against the front 30 of the plaque 12. In another alternative, the ends 24 of the arms 17 could be threaded so that the cured animal foot 10 could be mounted to the plaque 12 by means of nuts turned onto the threaded wire ends 24. A kit is formed by the alum and salt pickle bath chemicals, the semi-stiff U-shaped wire, a plaque, and means for mounting the cured animal feet to the plaque.

It is understood that the invention is not confined to the particular construction and arrangement herein illustrated and described, but embraces such modified forms thereof as come within the scope of the following claims.

What is claimed is:

1. A cured animal foot for mounting to a plaque, comprising:
   (a) an animal foot including skin and bone and having a lower portion with digits and an upper portion which at an upper end thereof has been cut from a leg of the animal, the upper and lower portions being joined at a selected angle at a wrist joint; and
   (b) a semi-stiff wire inserted longitudinally into the animal foot and extending into both the upper and lower portions of the animal foot; wherein the animal foot was bent at the wrist at a selected angle and held thereat by the bent wire while the foot was cured in a bent configuration in a curing bath.

2. The cured animal foot of claim 1 wherein the semi-stiff wire is U-shaped, having two arms with one end each, and a juncture where the arms adjoin; and wherein the two arms of the wire were inserted by the ends thereof into the lower portion of the foot between two of the digits, and thence pushed to extend into the upper portion of the animal foot, before the animal foot was selectively bent at the wrist.

3. The cured animal foot of claim 2 wherein extended portions of the wire arms extend out beyond the cut end of the upper portion of the foot.

4. The cured animal foot of claim 2 wherein the two arms of the semi-stiff wire are pushed up the animal foot so that the juncture adjoining the arms lies obscured by the digits.

5. The cured animal foot of claim 1 wherein the animal foot is bent at the wrist at about a 90° angle.

6. An animal foot rack for hanging or placing articles thereon, comprising:
   (a) at least one cured animal foot, each including
      (i) an animal foot including skin and bone and having a lower portion with digits and an upper portiom which at an upper end thereof has been cut from a leg of an animal, the upper and lower portions being joined at a selected angle at a wrist joint; and
      (ii) a semi-stiff wire inserted longitudinally into the animal foot and extending into both the upper and lower portions of the animal foot, wherein the animal foot was bent at the wrist at a selected angle and held thereat by the bent wire while the foot was cured in a bent configuration in a curing bath;
   (b) a plaque on which each cured animal foot is mounted with its cut end abutting against the plaque; and
   (c) means for mounting each cured animal foot to the plaque.

7. The animal foot rack of claim 6 wherein the semi-stiff wire is U-shaped, having two arms with one end each, and a juncture where the arms adjoin; and wherein the two arms of the wire were inserted by the ends thereof into the lower portion of the foot between two of the digits, and thence pushed to extend into the upper portion of the animal foot, before the animal foot was bent at the wrist.

8. The animal foot rack of claim 7 wherein extended portions of the wire arms extend out beyond the cut end of the upper portion of the foot.

9. The animal foot rack of claim 8 wherein the mounting means includes a portion of the plaque behind each animal foot cut end, each plaque portion having two holes from a front to a back of the plaque to receive the extended portions of the wire arms therethrough, and a wound portion of the arms formed to a rear of the plaque by crossing the two extended portions and winding them around each other until tension in the arms pulls the cut end of each of the animal feet to firmly abut and press against the front of the plaque around the corresponding two holes.

10. The animal foot rack of claim 8 wherein the mounting means includes a portion of the plaque behind each animal foot cut end, each plaque portion having two holes from a front to a back of the plaque to receive the extended portions of the wire arms therethrough, and a clamp placed on each pair of extended arms to a rear of the plaque to hold the arms in tension so that the cut end of each animal foot firmly abuts and presses against the front of the plaque around the corresponding two holes.

11. The animal foot rack of claim 7 wherein the two arms of the semi-stiff wire are pushed up the animal foot so that the juncture adjoining the arms lies obscured by the digits.

12. The animal foot rack of claim 7 wherein the animal foot is bent at the wrist at about a 90° angle.

13. The animal foot rack of claim 6 including two cured animal feet and a rectangular plaque having two ends, each animal foot mounted on the rectangular plaque havng two ends near one of the ends thereof, whereby a rifle or bow may be placed on the rack resting on and extending between the two cured animal feet.

14. A method of making an animal foot rack for hanging or placing articles thereon, comprising:
   (a) providing at least one animal foot including skin, bone and some fresh flesh therebetween, and having a lower portion with digits and an upper portion which at an upper end thereof has been cut from a leg of an animal, the upper and lower portions being joined at a wrist joint so that the portions are substantially aligned with each other; and a semi-stiff wire;
   (b) inserting the semi-stiff wire longitudinally into the foot so that the wire extends into both the upper and lower portions of the foot;
   (c) bending the foot at the wrist to a selected angle, the semi-stiff wire maintaining the lower and upper portions of the foot at this selected angle to one another;
   (d) placing the animal foot into a curing bath for a sufficient period of time for the flesh and skin of the foot to cure and thereby to help maintain the upper and lower portions of the foot at the selected angle to one another; and (e) removing the cured animal foot from the bath to dry.

15. The method of claim 14 wherein the step of inserting the semi-stiff wire is carried out with a U-shaped wire having two arms with one end each, and a juncture where the two arms adjoin.

16. The method of claim 15 wherein the step of inserting the semi-stiff wire is carried out by first inserting the two ends of the wire into the lower portion of the foot between two of the digits, and then pushing the wire up the foot so that the wire extends up into an upper portion of the foot.

17. The method of claim 15 wherein the step of inserting the semi-stiff wire is carried out so that the wire is pushed upwardly to where the juncture of the wire is obscured by the digits.

18. The method of claim 15 wherein the step of inserting the semi-stiff wire is carried out so that extended portions of the wire arms extend out beyond the cut end of the upper portion of the foot.

19. The method of claim 18 further including the steps of:

(f) providing a plaque; and (g) mounting at least one cured animal foot to the plaque.

20. The method of claim 19 wherein the step of mounting each cured animal foot is carried out by putting two holes through portions of the plaque from a front to a back of the plaque behind where each animal foot cut end is to be placed, placing the extended portion of each wire arm through a hole and pulling the two arms of each wire through the holes so the cut end of each animal foot abuts against the front of the plaque, and crossing the two extended ends of the arms of each wire and winding them around each other so that the cut end of the foot presses against the front of the plaque.

21. The method of claim 19, wherein the step of mounting the animal feet is carried out by putting two holes through portions of the plaque from a front to a back of the plaque behind where each animal foot cut end is to be placed, placing the extended portion of each wire arm through a hole and pulling the two arms of each wire through the holes so that the cut end of each animal foot abuts against the front of the plaque, and clamping the extended portions of the wire arms against the back of the plaque to hold the arms in tension so that the cut end of the foot presses against the front of the plaque.

22. An animal foot rack produced in accordance with the process of claim 19.

23. The method of claim 14 wherein the step of bending the foot at the wrist is carried out so that the angle between the upper and lower portions of the feet is about 90°.

24. An cured animal foot produced in accordance with the process of claim 14.

25. An animal foot rack kit which is used for preparing and curing fresh animal feet each of which at an upper end thereof has been cut from the leg of an animal, the kit when constructed with the cured animal foot being suitable for hanging or placing articles thereon, the animal foot rack kit comprising:

(a) alum and salt pickle bath chemicals for curing the fresh animal foot;

(b) a semi-stiff U-shaped wire having two arms with one end each and a juncture where the arms adjoin, the semi-stiff wire being adapted to be insertable longitudinally into the fresh animal foot so as to extend into both an upper and a lower portion of the animal foot, so that the animal foot can be bent at a wrist thereof at a selected angle and held thereat by the bent wire while the foot is cured in the bent figuration in the curing bath;

(c) a plaque on which cured animal feet may be mounted with their cut ends abutting against the plaque;

(d) means for mounting the cured animal feet to the plaque.

* * * * *